US009874232B2

(12) United States Patent
Matsuzaki et al.

(10) Patent No.: US 9,874,232 B2
(45) Date of Patent: Jan. 23, 2018

(54) FLUID PRESSURE CONTROL APPARATUS

(71) Applicants: KYB Corporation, Tokyo (JP); KYB-YS CO., LTD., Nagano (JP)

(72) Inventors: Keiichi Matsuzaki, Nagano (JP); Hideki Miyashita, Nagano (JP)

(73) Assignees: KYB Corporation, Tokyo (JP); KYB-YS Co., Ltd., Nagano (JP)

( * ) Notice: Subject to any disclaimer, the term of this patent is extended or adjusted under 35 U.S.C. 154(b) by 247 days.

(21) Appl. No.: 14/909,753

(22) PCT Filed: Aug. 26, 2014

(86) PCT No.: PCT/JP2014/072297

§ 371 (c)(1),
(2) Date: Feb. 3, 2016

(87) PCT Pub. No.: WO2015/037433

PCT Pub. Date: Mar. 19, 2015

(65) Prior Publication Data

US 2016/0195111 A1 Jul. 7, 2016

(30) Foreign Application Priority Data

Sep. 13, 2013 (JP) ..... 2013-190373

(51) Int. Cl.
*F15B 13/042* (2006.01)
*F15B 11/00* (2006.01)
(Continued)

(52) U.S. Cl.
CPC ..... *F15B 11/003* (2013.01); *F15B 11/10* (2013.01); *F15B 13/01* (2013.01); *F15B 13/042* (2013.01);
(Continued)

(58) Field of Classification Search
CPC ..... F15B 11/003; F15B 11/10; F15B 13/01; F15B 13/042
(Continued)

(56) References Cited

U.S. PATENT DOCUMENTS

2009/0159143 A1 6/2009 Nishikawa et al.
2016/0032947 A1* 2/2016 Tanaka ..... F15B 11/003 60/429

FOREIGN PATENT DOCUMENTS

CN 101213375 A 7/2008
CN 202073855 U 12/2011
JP 10-246206 A 9/1998

* cited by examiner

*Primary Examiner* — F. Daniel Lopez
*Assistant Examiner* — Daniel Collins
(74) *Attorney, Agent, or Firm* — Rabin & Berdo, P.C.

(57) ABSTRACT

A fluid pressure control apparatus includes a pilot control valve configured to control a pilot pressure guided from a pilot pump to the control valve and a load retaining mechanism installed in the main passage. The load retaining mechanism includes an operated check valve configured to permit a flow of the working fluid from the load-side pressure chamber to the control valve in accordance with a back pressure and a switch valve configured to switch an action of the operated check valve. The switch valve has a discharge position configured to discharge the working fluid in a back pressure chamber when the pilot pressure has been guided from the pilot control valve. When the switch valve is set to the discharge position, the working fluid in the back pressure chamber is discharged to a tank via a drain port of the pilot control valve.

5 Claims, 9 Drawing Sheets

(51) Int. Cl.
*F15B 13/01* (2006.01)
*F15B 11/10* (2006.01)

(52) U.S. Cl.
CPC ..... *F15B 2211/30515* (2013.01); *F15B 2211/329* (2013.01)

(58) Field of Classification Search
USPC ..... 60/494
See application file for complete search history.

FLUID PRESSURE CONTROL APPARATUS

TECHNICAL FIELD

The present invention relates to a fluid pressure control apparatus that controls the operations of a hydraulic operating device.

BACKGROUND ART

JP 1998-246206A discloses a control valve apparatus including a pair of actuator ports, a spool, and a lock valve mechanism. The pair of actuator ports communicates with an actuator. The spool controls communication between the pair of actuator ports and each of a hydraulic pump and a tank. The lock valve mechanism is provided in an oil passage for one of the actuator ports, allows circulation of supply oil to the actuator, and allows circulation of return oil from the actuator only when an operation signal has been given. The lock valve mechanism includes a seat valve and a pilot valve portion. The seat valve opens and closes the oil passage. The pilot valve portion selectively brings a back pressure chamber of the seat valve into communication with an outlet side of the seat valve or the tank. The back pressure chamber of the seat valve communicates with the tank via a drain port formed in a valve block.

SUMMARY OF INVENTION

The control valve apparatus described in JP 1998-246206A requires installation of a dedicated drain pipe for connecting the drain port and the tank. For this reason, it is difficult to make this apparatus compact.

It is an object of the present invention to provide a compact fluid pressure control apparatus.

According to one aspect of the present invention, a fluid pressure control apparatus configured to control extension and retraction operations of a load-driving cylinder includes a pump configured to supply a working fluid to the cylinder; a control valve configured to control the extension and retraction operations of the cylinder by switching between supply and discharge of the working fluid supplied from the pump to the cylinder; a pilot control valve configured to control a pilot pressure guided from a pilot pump to the control valve; a main passage that connects the control valve and a load-side pressure chamber, the load-side pressure chamber of the cylinder configured to be subjected to a load pressure attributed to a load when the control valve is maintained in a neutral position; and a load retaining mechanism installed in the main passage. The load retaining mechanism includes an operated check valve configured to permit a flow of the working fluid from the control valve to the load-side pressure chamber, and to permit a flow of the working fluid from the load-side pressure chamber to the control valve in accordance with a back pressure; and a switch valve configured to operate in coordination with the control valve due to the pilot pressure guided via the pilot control valve, so as to switch an action of the operated check valve. The switch valve has a discharge position configured to discharge the working fluid in a back pressure chamber of the operated check valve when the pilot pressure has been guided from the pilot control valve. When the switch valve is set to the discharge position, the working fluid in the back pressure chamber is discharged to a tank via a drain port of the pilot control valve.

DESCRIPTION OF EMBODIMENTS

The following describes a fluid pressure control apparatus 100 according to an embodiment of the present invention with reference to the drawings.

Figure 1:
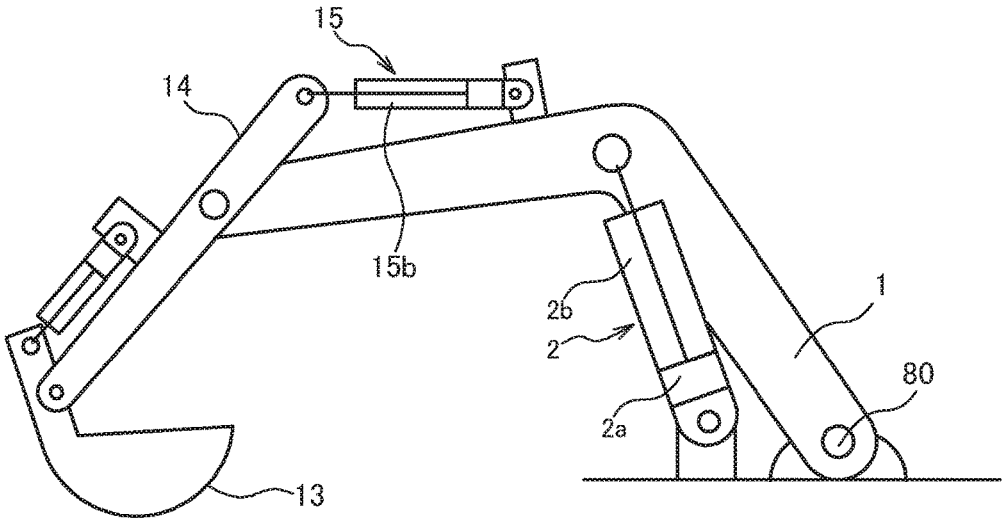
FIG. 1 shows a part of a hydraulic shovel.

The fluid pressure control apparatus 100 controls the operations of a hydraulic operating device, such as a hydraulic shovel. The description of the present embodiment pertains to a case in which the extension and retraction operations of a cylinder 2 that drives a boom (load) 1 of a hydraulic shovel shown in FIG. 1 are controlled.

First, a hydraulic circuit of the fluid pressure control apparatus 100 will be described with reference to FIGS. 2 to 4.

A piston rod 3*a* is inserted into the cylinder 2 in such a manner that the piston rod 3*a* can freely advance and recede. The inside of the cylinder 2 is partitioned into a counter-rod-side pressure chamber 2*a* and a rod-side pressure chamber 2*b* by a piston 3*b* that is joined to a tip of the piston rod 3*a*.

The hydraulic shovel is equipped with an engine, and the power of the engine drives a pump 4 and a pilot pump 5 that serve as hydraulic supply sources.

Working oil (working fluid) ejected from the pump 4 is supplied to the cylinder 2 via a control valve 6.

The control valve 6 and the counter-rod-side pressure chamber 2*a* of the cylinder 2 are connected by a first main passage 7, and the control valve 6 and the rod-side pressure chamber 2*b* of the cylinder 2 are connected by a second main passage 8.

The control valve 6 is operated by a pilot pressure that is guided from the pilot pump 5 to a first pilot chamber 6*a* or to a second pilot chamber 6*b* via a pilot control valve 90.

Figure 3:
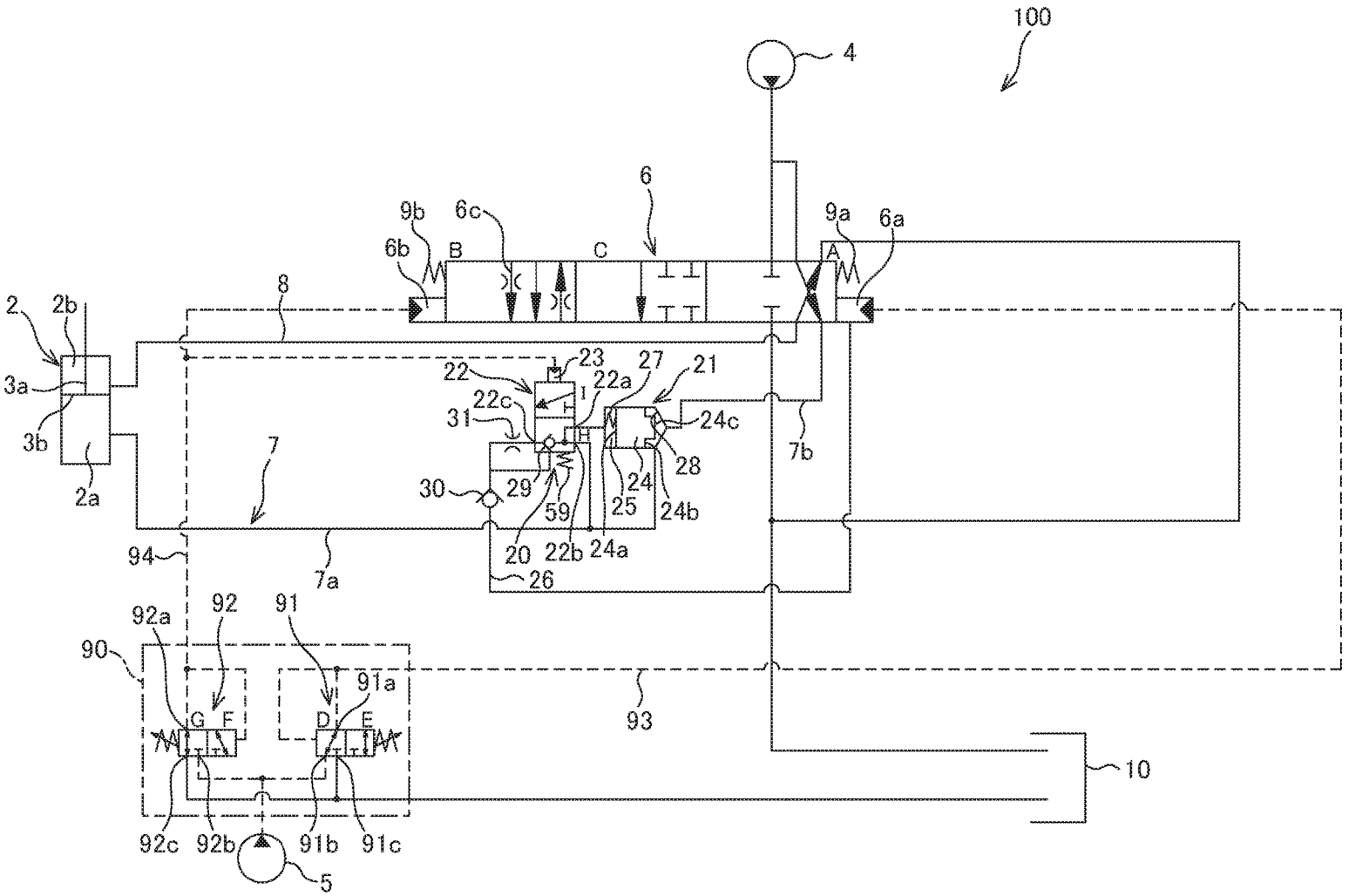
FIG. 3 is a hydraulic circuit diagram of the fluid pressure control apparatus according to the embodiment of the present invention, and shows the state in which the control valve is in an extension position.

Specifically, when the pilot pressure has been guided to the first pilot chamber 6*a*, the control valve 6 is switched to a position A, the working oil ejected from the pump 4 is supplied to the counter-rod-side pressure chamber 2*a* via the first main passage 7, and the working oil in the rod-side pressure chamber 2*b* is discharged to a tank 10 via the second main passage 8, as shown in FIG. 3. As a result, the cylinder 2 undergoes an extension operation, and the boom 1 pivots upward about a shaft 80 (see FIG. 1).

Figure 4:
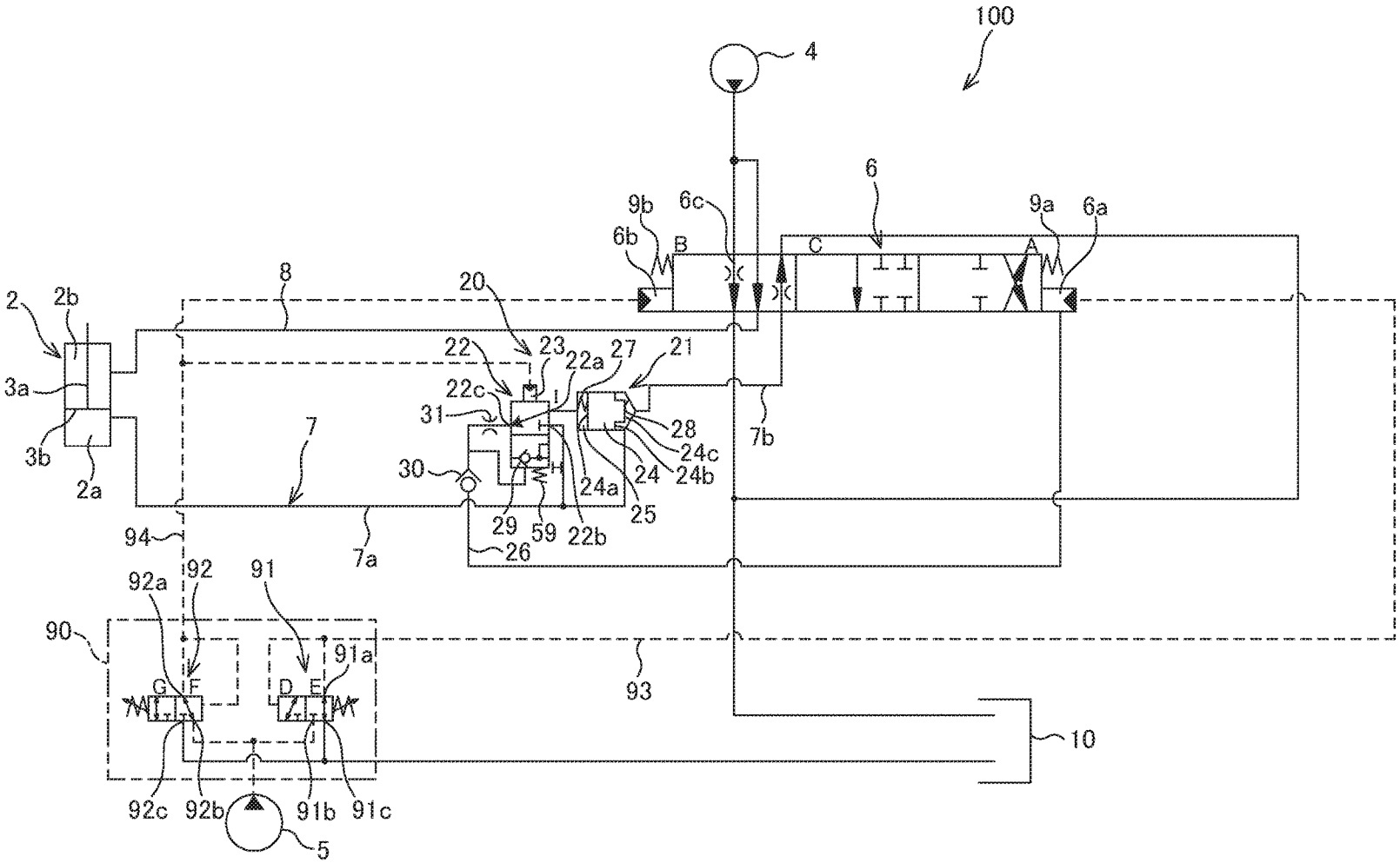
FIG. 4 is a hydraulic circuit diagram of the fluid pressure control apparatus according to the embodiment of the present invention, and shows the state in which the control valve is in a retraction position.

On the other hand, when the pilot pressure has been guided to the second pilot chamber 6*b*, the control valve 6 is switched to a position B, the working oil ejected from the pump 4 is supplied to the rod-side pressure chamber 2*b* via the second main passage 8, and the working oil in the counter-rod-side pressure chamber 2*a* is discharged to the tank 10 via the first main passage 7, as shown in FIG. 4. As a result, the cylinder 2 undergoes a retraction operation, and the boom 1 pivots downward about the shaft 80.

When the pilot pressure is guided to neither the first pilot chamber 6*a* nor the second pilot chamber 6*b*, the control valve 6 is switched to a position C, the supply and discharge of the working oil to and from the cylinder 2 are blocked, and the boom 1 remains in a stopped state.

As described above, the control valve 6 has three positions: an extension position A for causing the cylinder 2 to undergo the extension operation, a retraction position B for causing the cylinder 2 to undergo the retraction operation, and a neutral position C for retaining the load on the cylinder 2. The control valve 6 controls the extension and retraction operations of the cylinder 2 by switching between the supply and discharge of the working oil to and from the cylinder 2.

The pilot control valve 90 includes a first pilot control valve 91 that switches between the supply and discharge of the working oil to and from the first pilot chamber 6*a*, and a second pilot control valve 92 that switches between the supply and discharge of the working oil to and from the second pilot chamber 6*b*. The positions of the first pilot control valve 91 and the second pilot control valve 92 are switched by a crew of the hydraulic shovel manually operating an operation lever.

The first pilot control valve 91 includes a first pilot port 91*a* that communicates with the first pilot chamber 6*a*, a pump port 91*b* that communicates with the pilot pump 5, and a drain port 91*c* that communicates with the tank 10. The first pilot port 91*a* and the first pilot chamber 6*a* are connected via a first pilot passage 93.

The second pilot control valve 92 includes a second pilot port 92*a* that communicates with the second pilot chamber 6*b*, a pump port 92*b* that communicates with the pilot pump 5, and a drain port 92*c* that communicates with the tank 10. The second pilot port 92*a* and the second pilot chamber 6*b* are connected via a second pilot passage 94.

The first pilot control valve 91 has two positions, namely, a communication position D and a drain position E, and is an electromagnetic valve that is switched between the positions under an instruction signal output from a controller (not shown) in accordance with an operation of the operation lever by the crew. When the first pilot control valve 91 is in the communication position D, the first pilot port 91*a* and the pump port 91*b* communicate with each other, and pilot pressure oil ejected from the pilot pump 5 is supplied to the first pilot chamber 6*a*. When the first pilot control valve 91 is in the drain position E, the first pilot port 91*a* and the drain port 91*c* communicate with each other, and the first pilot chamber 6*a* communicates with the tank 10.

Similar to the first pilot control valve 91, the second pilot control valve 92 also has two positions, namely, a communication position F and a drain position G, and is an electromagnetic valve that is switched between the positions under an instruction signal output from the controller in accordance with an operation of the operation lever by the crew. When the second pilot control valve 92 is in the communication position F, the second pilot port 92*a* and the pump port 92*b* communicate with each other, and the pilot pressure oil ejected from the pilot pump 5 is supplied to the second pilot chamber 6*b*. When the second pilot control valve 92 is in the drain position G, the second pilot port 92*a* and the drain port 92*c* communicate with each other, and the second pilot chamber 6*b* communicates with the tank 10.

The pilot control valve 90 is controlled in such a manner that the second pilot control valve 92 is switched to the drain position G when the first pilot control valve 91 has been switched to the communication position D (the state shown in FIG. 3), and the first pilot control valve 91 is switched to the drain position E when the second pilot control valve 92 has been switched to the communication position F (the state shown in FIG. 4). That is to say, the control valve 6 is controlled in such a manner that the second pilot chamber 6*b* communicates with the tank 10 when the pilot pressure has been guided to the first pilot chamber 6*a*, and the first pilot chamber 6*a* communicates with the tank 10 when the pilot pressure has been guided to the second pilot chamber 6*b*.

When the movement of the boom 1 has been stopped by switching the control valve 6 to the neutral position C while a bucket 13 is lifted up as shown in FIG. 1, a force in the direction of retraction acts on the cylinder 2 due to the weights of the bucket 13, an arm 14, the boom 1, etc. Hence, in the cylinder 2 that drives the boom 1, the counter-rod-side pressure chamber 2*a* serves as a load-side pressure chamber on which a load pressure acts when the control valve 6 is in the neutral position C.

A load retaining mechanism 20 is installed in the first main passage 7 that is connected to the counter-rod-side pressure chamber 2*a*, which is the load side. The load retaining mechanism 20 retains the load pressure on the counter-rod-side pressure chamber 2*a* when the control valve 6 is in the neutral position C.

Meanwhile, in a cylinder 15 that drives the arm 14, a rod-side pressure chamber 15*b* serves as a load-side pressure chamber as shown in FIG. 1. Therefore, when the load retaining mechanism 20 is provided in the arm 14, the load retaining mechanism 20 is installed in a main passage connected to the rod-side pressure chamber 15*b*.

The load retaining mechanism 20 includes an operated check valve 21, a switch valve 22, and a discharge passage 26. The operated check valve 21 is installed in the first main passage 7. The switch valve 22 operates in coordination with the control valve 6 due to the pilot pressure guided to a pilot chamber 23 via the second pilot control valve 92 of the pilot control valve 90, so as to switch the action of the operated check valve 21. The discharge passage 26 is connected to the switch valve 22.

The operated check valve 21 includes a valve body 24 that opens and closes the first main passage 7, a seat portion 28 on which the valve body 24 is seated, and a back pressure chamber 25 defined by a back surface of the valve body 24.

While the valve body 24 is seated on the seat portion 28, the first main passage 7 is separated into a cylinder-side first main passage 7*a* and a control-valve-side first main passage 7*b*.

A spring 27 is housed in the back pressure chamber 25. The spring 27 serves as a pushing member that pushes the valve body 24 in a valve closing direction. The pressure in the back pressure chamber 25 and the pushing force of the spring 27 act in a direction for making the valve body 24 seated on the seat portion 28.

While the valve body 24 is seated on the seat portion 28, the operated check valve 21 exerts a function as a check valve that blocks the flow of the working oil from the counter-rod-side pressure chamber 2*a* to the control valve 6. That is to say, the operated check valve 21 maintains the stopped state of the boom 1 (the state shown in FIG. 2) by retaining the load pressure while preventing leakage of the working oil inside the counter-rod-side pressure chamber 2*a*.

The switch valve 22 includes a back pressure port 22*a* that communicates with the back pressure chamber 25 of the operated check valve 21, a load port 22*b* that communicates with the counter-rod-side pressure chamber 2*a* of the cylinder 2, and a discharge port 22*c* that communicates with the discharge passage 26.

The switch valve 22 has two positions: a pressure guiding position H for guiding the load pressure on the counter-rod-side pressure chamber 2*a*, which is the load-side pressure chamber, to the back pressure chamber 25, and a discharge position I for discharging the working oil in the back pressure chamber 25. The switch valve 22 is switched between the positions in accordance with the pilot pressure guided to the pilot chamber 23.

When the pilot pressure is not guided to the pilot chamber 23, the switch valve 22 is placed in the pressure guiding position H (the state shown in FIGS. 2 and 3) due to the pushing force of a spring 59. When the pilot pressure has been guided to the pilot chamber 23 via the second pilot control valve 92, the spring 59 is compressed, and the switch valve 22 is placed in the discharge position I (the state shown in FIG. 4). When the switch valve 22 is in the pressure guiding position H, the back pressure port 22*a* and the load port 22*b* communicate with each other, whereas communication between the back pressure port 22*a* and the discharge port 22*c* is blocked by a check valve 29. Therefore, the load pressure on the counter-rod-side pressure chamber 2*a* is guided to the back pressure chamber 25. When the switch valve 22 is in the discharge position I, the back pressure port 22*a* and the discharge port 22*c* communicate with each other, and the working oil in the back pressure chamber 25 is discharged.

The discharge passage 26 connects the switch valve 22 and the first pilot chamber 6*a* of the control valve 6, and guides the working oil discharged from the back pressure chamber 25 to the first pilot chamber 6*a*. It should be noted that the discharge passage 26 may be configured to connect the switch valve 22 and the first pilot passage 93, instead of connecting the switch valve 22 and the first pilot chamber 6*a*.

The discharge passage 26 is provided with a check valve 30 that permits only the flow of the working oil from the back pressure chamber 25 to the first pilot chamber 6*a*.

Next, the operations of the fluid pressure control apparatus 100 will be described with reference to FIGS. 2 to 4.

Figure 2:
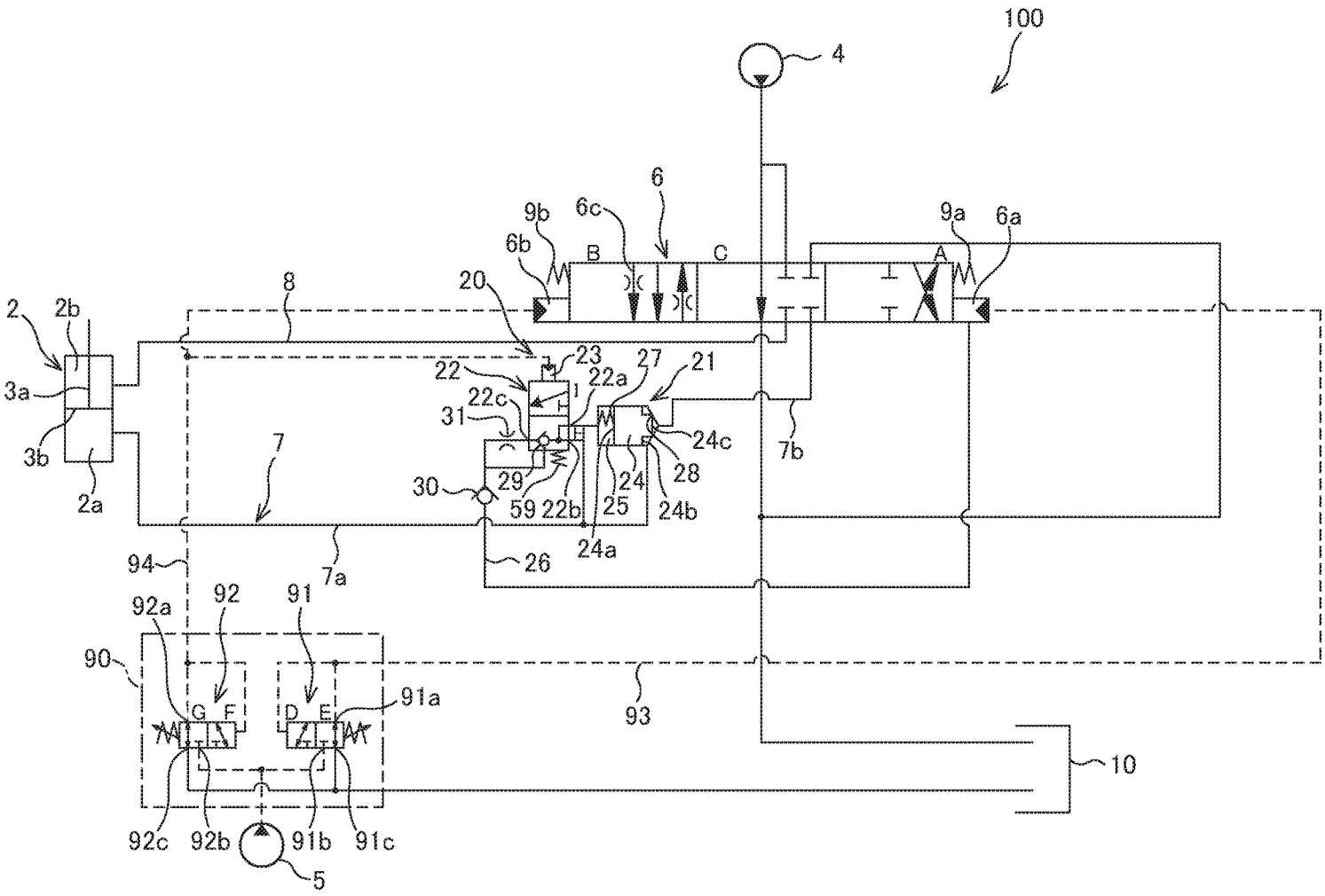
FIG. 2 is a hydraulic circuit diagram of a fluid pressure control apparatus according to an embodiment of the present invention, and shows the state in which a control valve is in a neutral position.

As shown in FIG. 2, when both of the first pilot control valve 91 and the second pilot control valve 92 are in the drain positions E, G, the first pilot chamber 6*a* and the second pilot chamber 6*b* communicate with the tank 10 via the first pilot control valve 91 and the second pilot control valve 92, and therefore the control valve 6 is maintained at the neutral position C due to the pushing forces of springs 9*a*, 9*b*. When the control valve 6 is in the neutral position C, the supply and discharge of the working oil to and from the cylinder 2 is blocked, and the entirety of the working oil ejected from the pump 4 is guided to the tank 10.

When the second pilot control valve 92 is in the drain position G, the pilot pressure is not guided to the pilot chamber 23 of the switch valve 22, either, and therefore the switch valve 22 is placed in the pressure guiding position H due to the pushing force of the spring 59. When the switch valve 22 is in the pressure guiding position H, the back pressure chamber 25 is maintained at the pressure in the counter-rod-side pressure chamber 2*a*. Here, the area of a pressure receiving surface of the valve body 24 opposing the valve closing direction (the area of a first pressure receiving surface 24*a* on which the pressure in the back pressure chamber 25 acts) is larger than the area of a pressure receiving surface of the valve body 24 opposing a valve opening direction (the area of a second pressure receiving surface 24*b* on which the pressure in the counter-rod-side pressure chamber 2*a* acts via the cylinder-side first main passage 7*a*). Therefore, the valve body 24 is seated on the seat portion 28 due to the pressure in the back pressure chamber 25 and the pushing force of the spring 27. In this way, the operated check valve 21 maintains the stopped state of the boom 1 while preventing leakage of the working oil inside the counter-rod-side pressure chamber 2*a*.

As shown in FIG. 3, when the first pilot control valve 91 is in the communication position D and the second pilot control valve 92 is in the drain position G, the pilot pressure is guided to the first pilot chamber 6*a* via the first pilot control valve 91, and the second pilot chamber 6*b* communicates with the tank 10 via the second pilot control valve 92. Accordingly, the control valve 6 is switched to the extension position A by an amount corresponding to the pilot pressure in the first pilot chamber 6*a*. When the control valve 6 is in the extension position A, the pressure of the working oil ejected from the pump 4 acts on a third pressure receiving surface 24*c* of the valve body 24. At this time, the switch valve 22 is placed in the pressure guiding position H with no pilot pressure guided to the pilot chamber 23, and therefore the back pressure chamber 25 is maintained at the pressure in the counter-rod-side pressure chamber 2*a*. However, the valve body 24 is detached from the seat portion 28 because the load acting on the third pressure receiving surface 24*c* of the valve body 24 due to an ejection pressure from the pump 4 is larger than a load sum derived from the load acting on the first pressure receiving surface 24*a* of the valve body 24 due to the pressure in the back pressure chamber 25, and from the pushing force of the spring 27.

Once the operated check valve 21 is opened in this manner, the working oil ejected from the pump 4 is supplied to the counter-rod-side pressure chamber 2*a*, the working oil in the rod-side pressure chamber 2*b* is discharged to the tank 10, and the cylinder 2 extends. Consequently, the boom 1 pivots upward about the shaft 80.

When the pilot pressure is guided to the first pilot chamber 6*a*, the pilot pressure is also guided to the discharge passage 26 that communicates with the first pilot chamber 6*a*. However, as the discharge passage 26 is provided with the check valve 30, the pilot pressure in the first pilot chamber 6*a* is not guided to the back pressure chamber 25. This prevents a situation in which an opening operation of the operated check valve 21 is influenced by the pilot pressure in the first pilot chamber 6*a*. Even if the pilot pressure in the first pilot chamber 6*a* is guided to the back pressure chamber 25 via the discharge passage 26, the operated check valve 21 still undergoes the opening operation because the load acting on the valve body 24 in the valve opening direction due to the ejection pressure from the pump 4 is sufficiently large compared to the load acting on the valve body 24 in the valve closing direction. For this reason, the check valve 30 need not be necessarily provided in the discharge passage 26.

As shown in FIG. 4, when the first pilot control valve 91 is in the drain position E and the second pilot control valve 92 is in the communication position F, the pilot pressure is guided to the second pilot chamber 6*b* via the second pilot control valve 92, and the first pilot chamber 6*a* communicates with the tank 10 via the first pilot control valve 91. Accordingly, the control valve 6 is switched to the retraction position B by an amount corresponding to the pilot pressure in the second pilot chamber 6*b*. At the same time, the pilot pressure is also guided to the pilot chamber 23 of the switch valve 22, and the switch valve 22 is switched to the discharge position I. Once the switch valve 22 is switched to the discharge position I, the working oil in the back pressure chamber 25 is discharged to the tank 10 via the discharge passage 26, the first pilot chamber 6*a*, the first pilot passage 93, and the drain port 91*c* of the first pilot control valve 91. As the pressure inside the back pressure chamber 25 is consequently reduced, the force acting on the valve body 24 in the valve closing direction becomes small, the valve body 24 is detached from the seat portion 28, and the function of the operated check valve 21 as the check valve is cancelled.

In this way, the operated check valve 21 operates so as to permit the flow of the working oil from the control valve 6 to the counter-rod-side pressure chamber 2*a*, and to permit the flow of the working oil from the counter-rod-side pressure chamber 2*a* to the control valve 6 in accordance with the pressure in the back pressure chamber 25.

Although the working oil in the back pressure chamber 25 passes through the first pilot chamber 6*a* in the course of discharge to the tank 10, this does not unfavorably influence the operation for switching the control valve 6 to the retraction position B because the capacity of the back pressure chamber 25 is small.

Once the operated check valve 21 is opened, the working oil ejected from the pump 4 is supplied to the rod-side pressure chamber 2*b*, the working oil in the counter-rod-side pressure chamber 2*a* is discharged to the tank 10, and the cylinder 2 retracts. Consequently, the boom 1 pivots downward about the shaft 80.

During the retraction of the cylinder 2, the weights of the boom 1 and the like also generate the force for causing the cylinder 2 to retract. Therefore, if the entirety of the working oil ejected from the pump 4 is supplied to the rod-side pressure chamber 2*b*, the retraction speed of the cylinder 2 becomes excessively high. In view of this, the control valve 6 is provided with a bleed-off passage 6*c* that, in the retraction position B, guides a part of the working oil ejected from the pump 4 to the tank 10.

Furthermore, the switch valve 22 is provided with a throttle 31. The throttle 31 restrains a sudden discharge of the working oil in the back pressure chamber 25. As a result, a sudden retraction operation of the cylinder 2 is restrained.

Figure 5:
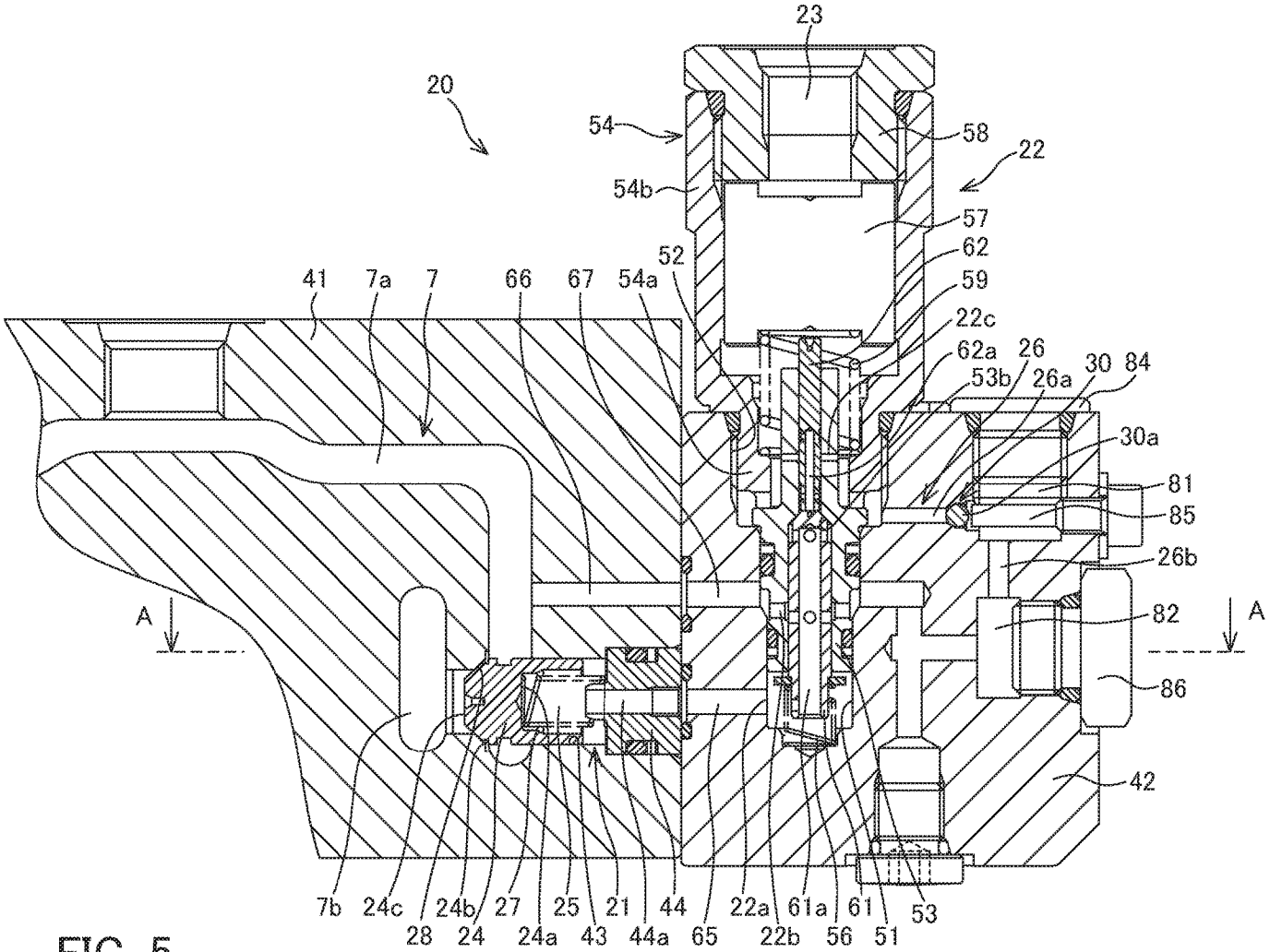
FIG. 5 is a cross-sectional view of a load retaining mechanism of the fluid pressure control apparatus according to the embodiment of the present invention, and shows the state in which the control valve is in the neutral position.
Figure 6:
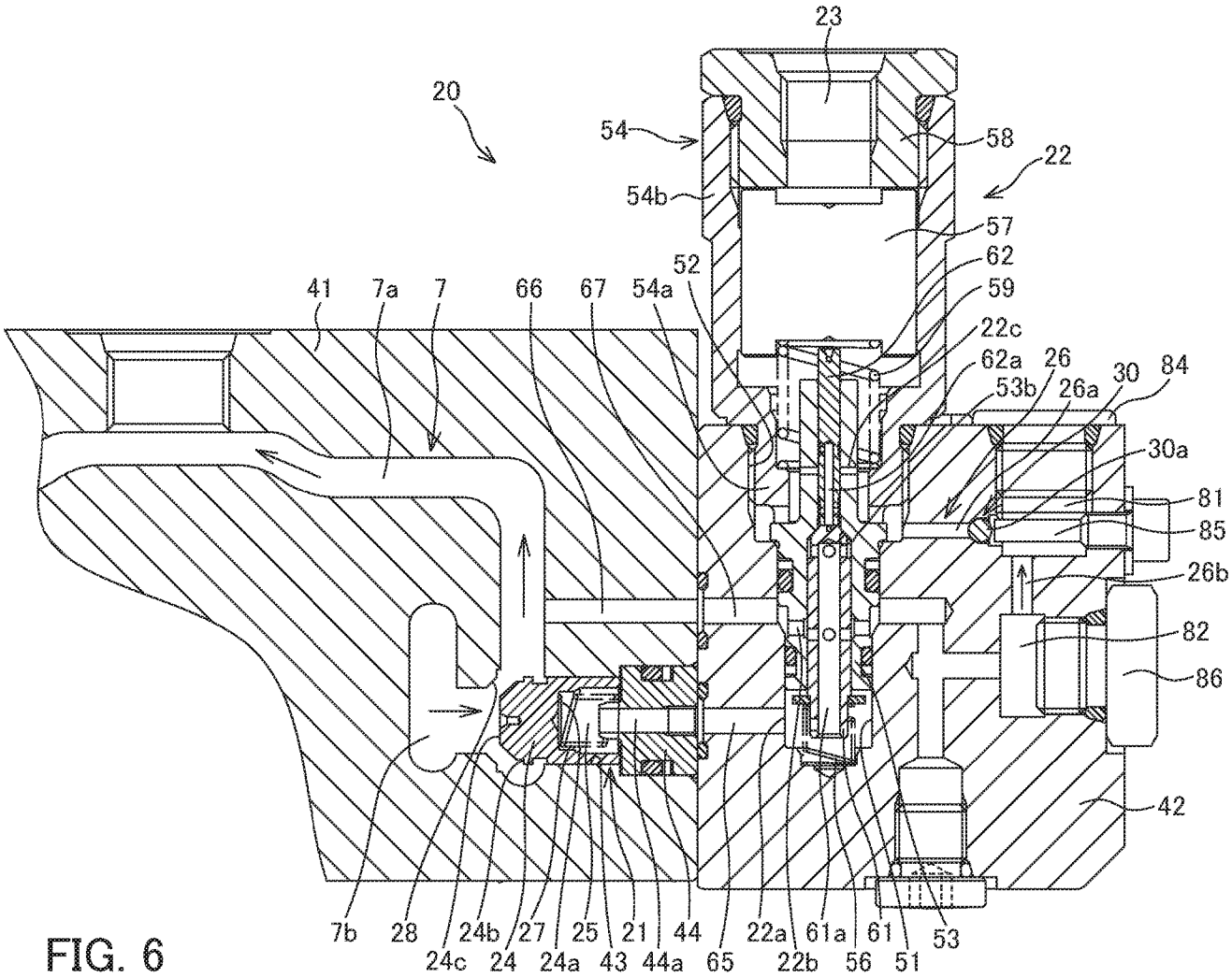
FIG. 6 is a cross-sectional view of the load retaining mechanism of the fluid pressure control apparatus according to the embodiment of the present invention, and shows the state in which the control valve is in the extension position.
Figure 7:
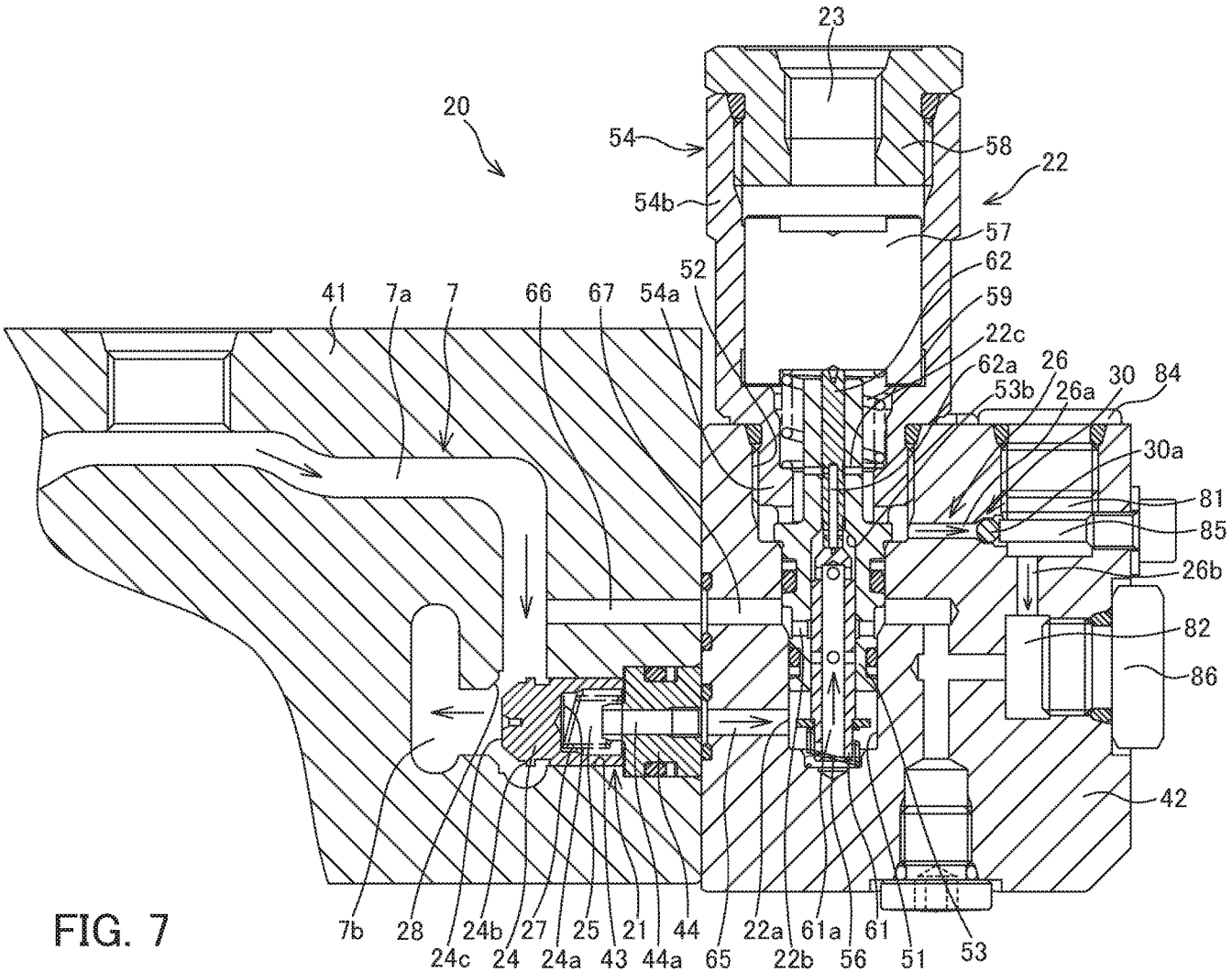
FIG. 7 is a cross-sectional view of the load retaining mechanism of the fluid pressure control apparatus according to the embodiment of the present invention, and shows the state in which the control valve is in the retraction position.
Figure 8:
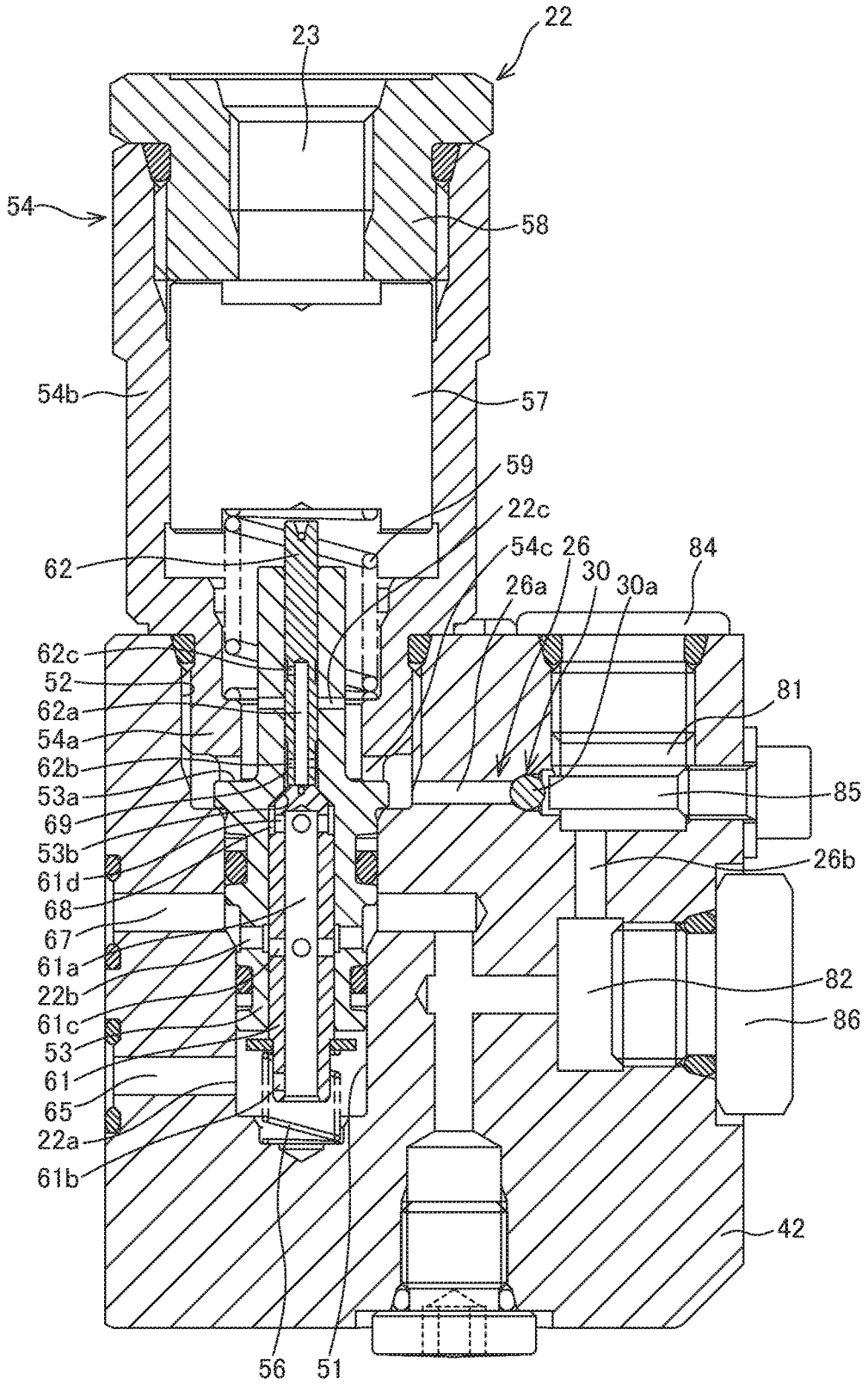
FIG. 8 is an enlarged cross-sectional view of a switch valve.
Figure 9:
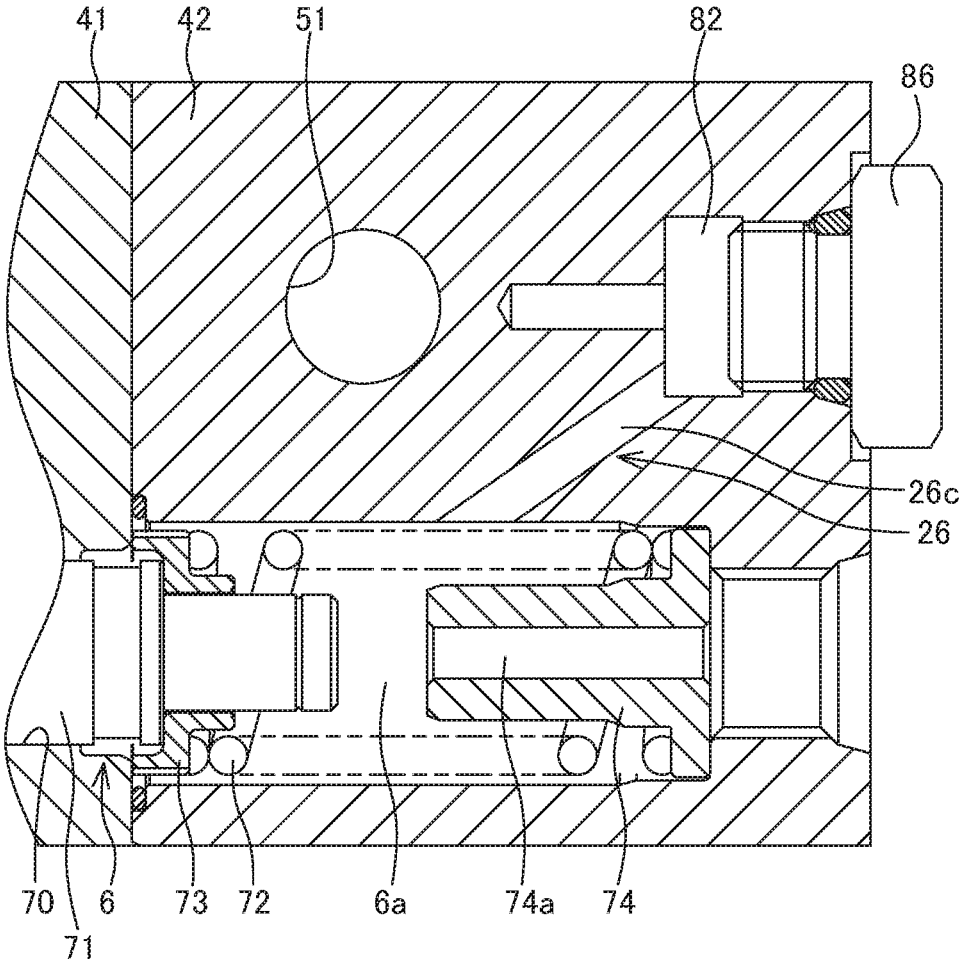
FIG. 9 is a cross-sectional view taken along the line A-A of FIG. 5.

A configuration of the load retaining mechanism 20 will now be described with reference to FIGS. 5 to 8. FIGS. 5 to 7 are cross-sectional views of the load retaining mechanism 20. FIGS. 5, 6, and 7 show the states in which the control valve 6 is in the neutral position C, the extension position A, and the retraction position B, respectively. FIG. 8 is an enlarged cross-sectional view of the switch valve 22, and FIG. 9 is a cross-sectional view taken along the line A-A of FIG. 5. It should be noted that the constituents in FIGS. 5 to 9 that are the same as their counterparts in FIGS. 1 to 4 are given the same reference signs thereas.

The operated check valve 21 is built in a first body 41, whereas the switch valve 22 is built in a second body 42. The control valve 6 (see FIG. 9) is built so as to extend across the first body 41 and the second body 42. The first body 41 and the second body 42 are fastened to each other with their end surfaces being in contact with each other.

As shown in FIG. 5, a slide hole 43 is formed in the first body 41, and the valve body 24 of the operated check valve 21 is slidably incorporated in the slide hole 43. An open end of the slide hole 43 is closed by a spring bearing member 44, and the back pressure chamber 25 is defined between the spring bearing member 44 and the valve body 24. The spring 27, which pushes the valve body 24 in the valve closing direction, is housed in the back pressure chamber 25. While the valve body 24 is seated on the seat portion 28 due to the pressure in the back pressure chamber 25 and the pushing force of the spring 27, communication between the cylinder-side first main passage 7*a* and the control-valve-side first main passage 7*b* is blocked.

As shown in FIGS. 5 and 8, a first spool hole 51 and a second spool hole 52 are formed in the second body 42. The second spool hole 52 has a larger inner diameter than the first spool hole 51. The second spool hole 52 is formed continuously with the first spool hole 51, and opens at an end surface of the second body 42.

A first sleeve 53 fits in the first spool hole 51. A part of a second sleeve 54 is fastened and fixed to the second spool hole 52. The second sleeve 54 has a fastened portion 54*a* that is fastened to the second spool hole 52, and a main body portion 54*b* that has a larger outer diameter than the fastened portion 54*a* and projects outside the second body 42. The first sleeve 53 is fixed by the second sleeve 54 due to a tip portion of the fastened portion 54*a* of the second sleeve 54 coming into contact with a shoulder end surface 53*a* of the first sleeve 53. A plurality of cutouts 54*c* are formed in the tip portion of the fastened portion 54*a*.

A spool 61 and a rod 62 are slidably inserted into the first sleeve 53. The spool 61 and the rod 62 are arranged so as to oppose each other. A spring 56 that pushes the spool 61 is provided between a bottom portion of the first spool hole 51 and the spool 61. The pushing force of the spring 56 makes a tip portion of the spool 61 seated on a valve seat 53*b* formed on the inner periphery of the first sleeve 53. The tip portion of the spool 61 and the valve seat 53*b* correspond to the check valve 29 shown in FIGS. 2 to 4.

A piston 57 is slidably inserted into the main body portion 54*b* of the second sleeve 54. An opening of the main body portion 54*b* is sealed by a plug 58 in which the pilot chamber 23 is formed. The piston 57 is arranged such that one end surface thereof opposes the rod 62, whereas the other end surface thereof opposes the pilot chamber 23.

The spring 59 is interposed between a step portion formed on the inner periphery of the fastened portion 54*a* of the second sleeve 54 and the piston 57. When the pilot pressure is not guided to the pilot chamber 23, the piston 57 is in contact with an end surface of the plug 58 due to the pushing force of the spring 59. When the pilot pressure has been guided to the pilot chamber 23, the piston 57 moves against the pushing force of the spring 59, thereby causing the rod 62 to advance. Once the rod 62 advances, the spool 61 recedes against the pushing force of the spring 56, and the tip portion of the spool 61 is detached from the valve seat 53*b*.

A first pressure chamber 68 is formed between the outer peripheral surface of the tip side of the spool 61 and the inner peripheral surface of the first sleeve 53. Furthermore, a second pressure chamber 69 is formed between the outer peripheral surface of the tip side of the rod 62 and the inner peripheral surface of the first sleeve 53. While the tip portion of the spool 61 is seated on the valve seat 53*b* of the first sleeve 53, the first pressure chamber 68 and the second pressure chamber 69 are isolated from each other. While the tip portion of the spool 61 is detached from the valve seat 53*b*, the first pressure chamber 68 and the second pressure chamber 69 communicate with each other.

The back pressure port 22*a* is formed in the first spool hole 51. The back pressure port 22*a* communicates with the back pressure chamber 25 via an oil passage 44*a* formed in the spring bearing member 44, and via an oil passage 65 formed in the second body 42.

The load port 22*b* is formed in the first sleeve 53. The load port 22*b* communicates with the cylinder-side first main passage 7*a* via an oil passage 66 formed in the first body 41, and via an oil passage 67 formed in the second body 42. The load port 22*b* is formed in such a manner that it penetrates the first sleeve 53 across the inner and outer peripheral surfaces of the first sleeve 53.

The discharge port 22*c*, which communicates with the discharge passage 26, is also formed in the first sleeve 53. The discharge port 22*c* is formed in such a manner that it penetrates the first sleeve 53 across the inner and outer peripheral surfaces of the first sleeve 53.

The spool 61 has an in-spool passage 61*a* that is formed along the axial direction. Three through-holes 61*b*, 61*c*, 61*d* are formed in a barrel portion of the spool 61. The three through-holes 61*b*, 61*c*, 61*d* communicate with the in-spool passage 61*a*, and open at the outer peripheral surface of the barrel portion of the spool 61. The in-spool passage 61*a* and the back pressure port 22*a* always communicate with each other via the through-hole 61*b*. In accordance with a movement of the spool 61, the through-hole 61*c* either brings the in-spool passage 61*a* and the load port 22*b* into communication with each other, or isolates the in-spool passage 61*a* and the load port 22*b* from each other. The first pressure chamber 68 and the in-spool passage 61*a* always communicate with each other via the through-hole 61*d*.

The rod 62 has an in-rod passage 62*a* that is formed along the axial direction. Two through-holes 62*b*, 62*c* are formed in a barrel portion of the rod 62. The two through-holes 62*b*, 62*c* communicate with the in-rod passage 62*a*, and open at the outer peripheral surface of the barrel portion of the rod 62. The second pressure chamber 69 and the in-rod passage 62*a* always communicate with each other via the through-hole 62*b*. In accordance with a movement of the rod 62, the through-hole 62*c* either brings the in-rod passage 62*a* and the discharge port 22*c* into communication with each other, or isolates the in-rod passage 62*a* and the discharge port 22*c* from each other. The through-hole 62*b* corresponds to the throttle 31 shown in FIG. 2.

As shown in FIG. 9, the control valve 6 includes a spool 71 and the first pilot chamber 6*a*. The spool 71 has been slidably inserted in a slide hole 70 formed in the first body 41. In the second body 42, the first pilot chamber 6*a* is formed continuously with the slide hole 70, and faces one end portion of the spool 71. Although omitted from FIG. 9, the second pilot chamber 6*b* that faces the other end portion of the spool 71 is formed the first body 41.

A centering spring 72 that pushes one end portion of the spool 71 is housed inside the first pilot chamber 6*a*. The centering spring 72 is interposed between a pair of spring bearing members 73, 74. An oil passage 74*a* that penetrates the spring bearing member 74 in the axial direction is formed in the spring bearing member 74. The pilot pressure oil supplied via the first pilot control valve 91 is guided to the first pilot chamber 6*a* via the first pilot passage 93 and the oil passage 74*a*.

When the cylinder 2 undergoes the extension operation, the pilot pressure is guided to the first pilot chamber 6*a* via the first pilot control valve 91, and the second pilot chamber 6*b* communicates with the tank 10 via the second pilot control valve 92. Consequently, the spool 71 moves to the left side of FIG. 9, the working oil is supplied to the counter-rod-side pressure chamber 2*a* via the spool 71, and the working oil is discharged from the rod-side pressure chamber 2*b*. On the other hand, when the cylinder 2 undergoes the retraction operation, the pilot pressure is guided to the second pilot chamber 6*b* via the second pilot control valve 92, and the first pilot chamber 6*a* communicates with the tank 10 via the first pilot control valve 91. Consequently, the spool 71 moves to the right side of FIG. 9, the working oil is supplied to the rod-side pressure chamber 2*b* via the spool 71, and the working oil is discharged from the counter-rod-side pressure chamber 2*a*.

As shown in FIGS. 5 and 9, the discharge passage 26 is composed of a first discharge passage 26*a*, a second discharge passage 26*b*, and a third discharge passage 26*c* (see FIG. 9) that are formed in the second body 42. The discharge port 22*c* and a drain pipe connection port 81 that opens into the second body 42 communicate with each other via the first discharge passage 26*a*. The drain pipe connection port 81 and a pressure chamber 82 that opens into the second body 42 communicate with each other via the second discharge passage 26*b*. The pressure chamber 82 and the first pilot chamber 6*a* communicate with each other via the third discharge passage 26*c* (see FIG. 9).

The drain pipe connection port 81 is a port that is used when the working oil that has been discharged from the back pressure chamber 25 via the switch valve 22 is discharged to the tank 10 via a dedicated drain pipe, instead of being discharged to the tank 10 via the first pilot passage 93. The drain pipe is attached to the drain pipe connection port 81 so as to connect the drain pipe connection port 81 and the tank 10.

When the working oil that has been discharged from back pressure chamber 25 via the switch valve 22 is discharged to the tank 10 via the first pilot passage 93, the drain pipe connection port 81 is not used, and therefore an opening of the drain pipe connection port 81, which opens into the second body 42, is sealed by a plug 84.

A ball 30*a* of the check valve 30 is provided between the first discharge passage 26*a* and the drain pipe connection port 81. The ball 30*a* is larger than the inner diameter of the first discharge passage 26*a*, and is provided between an open end of the first discharge passage 26*a* and a tip surface of a plug 85 that is inserted in the drain pipe connection port 81. When the working oil in the back pressure chamber 25 is discharged via the switch valve 22, the ball 30*a* comes into contact with the tip surface of the plug 85. Consequently, the check valve 30 is opened. On the other hand, when the pilot pressure oil is guided to the first pilot chamber 6*a* via the first pilot control valve 91, the pilot pressure oil guided to the drain pipe connection port 81 via the third discharge passage 26*c* and the second discharge passage 26*b* causes the ball 30*a* to close the open end of the first discharge passage 26*a*. Consequently, the check valve 30 is closed.

The pressure chamber 82 and the first pilot chamber 6*a* are connected in a straight line shape by the third discharge passage 26*c*. The third discharge passage 26*c* is formed by inserting a drill bit in an opening of the pressure chamber 82 formed in the second body 42 and causing the drill bit to penetrate the second body 42 until it reaches the first pilot chamber 6*a*. The opening of the pressure chamber 82, which opens into the second body 42, is sealed by a plug 86.

The operations of the load retaining mechanism 20 and the control valve 6 will now be described mainly with reference to FIGS. 5 to 9.

When both of the first pilot control valve 91 and the second pilot control valve 92 are in the drain positions E, G, the first pilot chamber 6*a* and the second pilot chamber 6*b* communicate with the tank 10. Consequently, the control valve 6 is placed in the neutral position C (see FIG. 2). Furthermore, as shown in FIG. 5, the pilot pressure is not guided to the pilot chamber 23 of the switch valve 22, either, and therefore the piston 57 is in contact with the end surface of the plug 58 due to the pushing force of the spring 59, and does not apply a thrust force to the rod 62. Consequently, the spool 61 is seated on the valve seat 53*b* due to the pushing force of the spring 56. This blocks communication between the back pressure port 22*a* and the discharge port 22*c*, and prevents discharge of the working oil in the back pressure chamber 25 to the discharge passage 26.

Meanwhile, the working oil in the counter-rod-side pressure chamber 2*a* is guided to the back pressure chamber 25 via the cylinder-side first main passage 7*a*, the oil passage 66, the oil passage 67, the load port 22*b*, the through-hole 61*c*, the in-spool passage 61*a*, the through-hole 61*b*, the back pressure port 22*a*, the oil passage 65, and the oil passage 44*a*.

In this way, when both of the first pilot control valve 91 and the second pilot control valve 92 are in the drain positions E, G, the switch valve 22 operates so as to block communication between the back pressure port 22*a* and the discharge port 22*c*, and to bring the load port 22*b* and the back pressure port 22*a* into communication with each other (the pressure guiding position H).

When the first pilot control valve 91 is in the communication position D and the second pilot control valve 92 is in the drain position G, the pilot pressure is guided to the first pilot chamber 6*a*, and the second pilot chamber 6*b* communicates with the tank 10. Consequently, the control valve 6 is placed in the extension position A (see FIG. 3). Furthermore, as shown in FIG. 6, in the switch valve 22, the pilot pressure is not guided to the pilot chamber 23, and therefore the spool 61 is seated on the valve seat 53*b* due to the pushing force of the spring 56.

The pressure of the working oil ejected from the pump 4 acts on the third pressure receiving surface 24*c* of the valve body 24 of the operated check valve 21, and the valve body 24 is detached from the seat portion 28. Consequently, as indicated by arrows in FIG. 6, the working oil ejected from the pump 4 is supplied to the counter-rod-side pressure chamber 2*a*.

Furthermore, as the pilot pressure oil is guided to the first pilot chamber 6*a* via the first pilot control valve 91, the pilot pressure oil inside the first pilot chamber 6*a* also flows toward the switch valve 22 via the third discharge passage 26*c* (see FIG. 9) and the second discharge passage 26*b* as indicated by an arrow in FIG. 6. However, the check valve 30 provided between the first discharge passage 26*a* and the drain pipe connection port 81 prevents the pilot pressure oil inside the first pilot chamber 6*a* from being guided to the back pressure chamber 25 of the operated check valve 21 via the switch valve 22.

When the first pilot control valve 91 is in the drain position E and the second pilot control valve 92 is in the communication position F, the pilot pressure is guided to the second pilot chamber 6*b*, and the first pilot chamber 6*a* communicates with the tank 10. Consequently, the control valve 6 is placed in the retraction position B (see FIG. 4). Furthermore, as shown in FIG. 7, the pilot pressure is guided to the pilot chamber 23 of the switch valve 22, and hence the piston 57 moves against the pushing force of the spring 59, thereby causing the rod 62 to advance. Once the rod 62 advances, the spool 61 is pressed by the rod 62 and recedes against the pushing force of the spring 56, and the tip portion of the spool 61 is detached from the valve seat 53*b*. Consequently, the working oil in the back pressure chamber 25 is guided to the first discharge passage 26*a* via the oil passage 44*a*, the oil passage 65, the back pressure port 22*a*, the through-hole 61*b*, the in-spool passage 61*a*, the through-hole 61*d*, the first pressure chamber 68, the second pressure chamber 69, the through-hole 62*b*, the in-rod passage 62*a*, the through-hole 62*c*, the discharge port 22*c*, and the cutouts 54*c*. The working oil guided to the first discharge passage 26*a* pushes open the check valve 30, is guided to the first pilot chamber 6*a* via the second discharge passage 26*b* and the third discharge passage 26*c*, and then is discharged to the tank 10 via the first pilot passage 93 and the drain port 91*c* of the first pilot control valve 91. In this way, the working oil in the back pressure chamber 25 is discharged to the tank 10 via the switch valve 22, the discharge passage 26, the first pilot chamber 6*a*, the first pilot passage 93, and the drain port 91*c* of the first pilot control valve 91.

Meanwhile, as shown in FIG. 7, once the spool 61 recedes against the pushing force of the spring 56, communication between the load port 22*b* and the through-hole 61*c* of the spool 61 is blocked, with the result that communication between the load port 22*b* and the back pressure port 22*a* is blocked.

In this way, when the first pilot control valve 91 is in the drain position E and the second pilot control valve 92 is in the communication position F, the switch valve 22 operates so as to bring the back pressure port 22*a* and the discharge port 22*c* into communication with each other, and to block communication between the load port 22*b* and the back pressure port 22*a* (the discharge position I).

Modification examples of the present embodiment will now be described.

In the description of the foregoing embodiment, the check valve 30, which permits only the flow of the working oil from the back pressure chamber 25 to the first pilot chamber 6*a*, is provided between the first discharge passage 26*a* and the drain pipe connection port 81. Alternatively, the check valve 30 may be provided in the discharge passage 26 such that the check valve 30 is positioned downstream relative to the drain pipe connection port 81, specifically, in the second discharge passage 26*b* or the third discharge passage 26*c*. Locating the check valve 30 in this way enables the attachment of a dedicated drain pipe to the drain pipe connection port 81 for the purpose of discharging the working oil in the back pressure chamber 25 to the tank 10 via the drain pipe connection port 81. That is to say, in the case where the check valve 30 is provided between the first discharge passage 26*a* and the drain pipe connection port 81 as in the foregoing first embodiment, if a dedicated drain pipe is attached to the drain pipe connection port 81, the pilot pressure oil inside the first pilot chamber 6*a* is undesirably discharged to the tank 10 via the drain pipe connection port 81 when the control valve 6 is switched to the extension position A with the pilot pressure guided to the inside of the first pilot chamber 6*a*. In contrast, in the case where the check valve 30 is provided in the discharge passage 26 such that the check valve 30 is positioned downstream relative to the drain pipe connection port 81, even if a dedicated drain pipe is attached to the drain pipe connection port 81, the pilot pressure oil in the first pilot chamber 6*a* is not discharged to the tank 10 via the drain pipe connection port 81 when the control valve 6 is switched to the extension position A with the pilot pressure guided to the inside of the first pilot chamber 6*a*. By thus providing the check valve 30 in the discharge passage 26 such that the check valve 30 is positioned downstream relative to the drain pipe connection port 81, the working oil in the back pressure chamber 25 can be discharged to the tank 10 not only via the first pilot passage 93, as described in the foregoing embodiment, but also via the drain pipe connection port 81. In this way, a discharge destination of the working oil in the back pressure chamber 25 can be selected appropriately in accordance with the specifications of a hydraulic operating device equipped with the fluid pressure control apparatus 100.

The foregoing embodiment achieves the following effects.

When the switch valve 22 for switching the action of the operated check valve 21 is set to the discharge position I, the working oil in the back pressure chamber 25 is discharged to the tank 10 via the drain port 91*c* of the first pilot control valve 91. Accordingly, there is no need to provide a dedicated drain pipe for discharging the working oil in the back pressure chamber 25, and hence a compact fluid pressure control apparatus 100 can be obtained. Furthermore, as the dedicated drain pipe is unnecessary, the manufacturing cost of the fluid pressure control apparatus 100 can be lowered.

Moreover, as it is not necessary to attach the dedicated drain pipe to the drain pipe connection port 81, there will be no oil leakage from a connection portion between the drain pipe connection port 81 and the drain pipe. This improves the reliability of the fluid pressure control apparatus 100.

The embodiments of the present invention described above are merely illustration of some application examples of the present invention and not of the nature to limit the technical scope of the present invention to the specific constructions of the above embodiments.

The present application claims a priority based on Japanese Patent Application No. 2013-190373 filed with the Japan Patent Office on Sep. 13, 2013, all the contents of which are hereby incorporated by reference.

The invention claimed is:

1. A fluid pressure control apparatus configured to control extension and retraction operations of a load-driving cylinder, the fluid pressure control apparatus comprising:

a pump configured to supply a working fluid to the cylinder;

a control valve configured to control the extension and retraction operations of the cylinder by switching between supply and discharge of the working fluid supplied from the pump to the cylinder;

a pilot control valve configured to control a pilot pressure guided from a pilot pump to the control valve;

a main passage that connects the control valve and a load-side pressure chamber of the cylinder, the load-side pressure chamber being configured to be subjected to a load pressure attributed to a load when the control valve is maintained in a neutral position; and a load retaining mechanism installed in the main passage, the load retaining mechanism comprising:

an operated check valve configured to permit a flow of the working fluid from the control valve to the load-side pressure chamber, and to permit a flow of the working fluid from the load-side pressure chamber to the control valve in accordance with a back pressure; and a switch valve configured to operate in coordination with the control valve due to the pilot pressure guided via the pilot control valve, so as to switch an action of the operated check valve, wherein the switch valve has a discharge position configured to discharge the working fluid in a back pressure chamber of the operated check valve when the pilot pressure has been guided from the pilot control valve, and when the switch valve is set to the discharge position, the working fluid in the back pressure chamber is discharged to a tank via a drain port of the pilot control valve.

2. The fluid pressure control apparatus according to claim 1, wherein the control valve includes:

a first pilot chamber configured to take in the pilot pressure guided thereto via the pilot control valve, the first pilot chamber being configured to cause a spool to move so that the working fluid is supplied to the load-side pressure chamber of the cylinder; and a second pilot chamber configured to take in the pilot pressure guided thereto via the pilot control valve, the second pilot chamber being configured to cause the spool to move so that the working fluid is discharged from the load-side pressure chamber of the cylinder, the pilot control valve has a first pilot port, a second pilot port, a pump port, and the drain port communicating respectively with the first pilot chamber, the second pilot chamber, the pilot pump, and the tank, and when the pilot control valve has been switched to bring the second pilot port and the pump port into communication with each other and to bring the first pilot port and the drain port into communication with each other, the working fluid in the back pressure chamber is discharged to the tank via the drain port of the pilot control valve.

3. The fluid pressure control apparatus according to claim 2, further comprising:

a first pilot passage connecting the first pilot chamber and the first pilot port of the pilot control valve;

a discharge passage connected to the switch valve, the discharge passage being configured to guide the working fluid discharged from the back pressure chamber to the first pilot chamber or the first pilot passage; and a check valve provided in the discharge passage, the check valve being configured to permit only a flow of the working fluid from the back pressure chamber to the first pilot port.

4. The fluid pressure control apparatus according to claim 3, wherein the discharge passage is formed inside a body housing the load retaining mechanism and the control valve.

5. The fluid pressure control apparatus according to claim 4, further comprising:

a drain pipe connection port communicating with the discharge passage, the drain pipe connection port opening into the body, wherein the check valve is provided in the discharge passage such that the check valve is positioned downstream relative to the drain pipe connection port.

* * * * *